US006095583A

United States Patent [19]

Beeman et al.

[11] Patent Number: 6,095,583

[45] Date of Patent: Aug. 1, 2000

[54] WELLBORE FISHING TOOLS

[75] Inventors: Robert S. Beeman, Bossier City; Clifford W. Hawn, Benton, both of La.

[73] Assignee: Weatherford/Lamb, Inc., Houston, Tex.

[21] Appl. No.: 08/878,526

[22] Filed: Jun. 9, 1997

Related U.S. Application Data

[63] Continuation-in-part of application No. 08/675,087, Jul. 3, 1996, Pat. No. 5,791,712.

[51] Int. Cl.[7] ..... E21B 31/18

[52] U.S. Cl. ..... 294/86.15; 294/86.17; 294/86.29; 294/86.3

[58] Field of Search ..... 294/86.15, 86.17, 294/86.26, 86.27, 86.28, 86.29, 86.3, 86.32, 86.33, 86.34

[56] References Cited

U.S. PATENT DOCUMENTS

| | | | |
|---|---|---|---|
| 803,450 | 10/1905 | Stegner . | |
| 808,378 | 12/1905 | Johnston . | |
| 1,457,139 | 5/1923 | Bell, et al. . | |
| 1,487,440 | 3/1924 | Butts . | |
| 1,580,352 | 4/1926 | Ventresca . | |
| 1,592,981 | 7/1926 | Ligon . | |
| 1,619,254 | 5/1927 | Hart . | |
| 1,621,947 | 3/1927 | Moore . | |
| 1,638,494 | 8/1927 | Lewis . | |
| 1,712,898 | 5/1929 | Newkirk . | |
| 1,728,136 | 9/1929 | Power . | |
| 1,728,781 | 9/1929 | Cameron . | |
| 1,779,123 | 10/1930 | Gates . | |
| 1,791,529 | 2/1931 | Lamoureaux et al. . | |
| 1,794,652 | 3/1931 | Stone . | |
| 1,815,462 | 7/1931 | Denney . | |
| 1,823,340 | 9/1931 | Vance . | |
| 1,917,135 | 7/1933 | Littell . | |
| 2,014,804 | 9/1935 | Hinderliter . | |
| 2,141,987 | 12/1938 | Jones | 294/96 |
| 2,245,571 | 6/1941 | Chappell | 294/86.24 |
| 2,290,409 | 7/1942 | Cuthill | 294/93 |
| 2,616,752 | 11/1952 | Osmun . | |
| 2,732,901 | 1/1956 | Davis | 166/98 |
| 2,806,534 | 9/1957 | Potts | 166/98 |
| 3,199,906 | 8/1965 | Chenoweth | 294/86.15 |
| 3,262,501 | 7/1966 | Winger | 166/31 |
| 3,265,431 | 8/1966 | Burner | 294/86.25 |
| 3,527,494 | 9/1970 | Young . | |
| 3,638,989 | 2/1972 | Sandquist | 294/86.24 |
| 4,030,745 | 6/1977 | Schoeffler et al. | 294/86.3 |
| 4,244,616 | 1/1981 | Buchalet | 294/86.15 |
| 4,443,130 | 4/1984 | Hall | 405/190 |
| 4,616,721 | 10/1986 | Furse | 175/320 |
| 4,723,372 | 2/1988 | Sheshtawy | 294/86.15 |
| 4,838,594 | 6/1989 | Bullard | 294/86.25 |
| 5,242,201 | 9/1993 | Beeman | 294/86.17 |
| 5,413,171 | 5/1995 | Womack | 166/98 |
| 5,580,114 | 12/1996 | Palmer | 294/86.15 |
| 5,639,135 | 6/1997 | Beeman | 294/86.25 |
| 5,765,638 | 6/1998 | Taylor | 166/98 |

FOREIGN PATENT DOCUMENTS

| | | |
|---|---|---|
| 2295410 | of 1995 | United Kingdom . |
| WO 96/16247 | of 1994 | WIPO . |

*Primary Examiner*—Dean J. Kramer
*Attorney, Agent, or Firm*—Guy McClung

[57] ABSTRACT

An apparatus for retrieving an object from a wellbore has been invented having an inner body and a longitudinal fluid flow bore therethrough, and at least one lateral flow bore therethrough, the bottom end having an opening suitable for receiving therein a fluid actuable member disposed for reciprocation with respect to the inner body, bias apparatus contacting the fluid actuable member for moving the fluid actuable member with respect to the inner body, and the fluid actuable member disposed so that the bias apparatus can push the fluid actuable member down to contact a plurality of fingers and move them into the longitudinal flow bore to engage the object in the wellbore when insufficient fluid pressure is present to overcome force of the bias apparatus in the fluid actuable member.

11 Claims, 5 Drawing Sheets

WELLBORE FISHING TOOLS

RELATED APPLICATION

This is a continuation-in-part of U.S. application Ser. No. 08/675,087 filed on Jul. 3, 1996, now U.S. Pat. No. 5,791,712 co-owned with the present invention, which is incorporated fully herein for all purposes.

BACKGROUND OF THE INVENTION

1. Field of the Invention

This invention relates to fishing tools and more particularly, to spear and overshot fishing tools designed to engage (in one aspect automatically) the receiving element or neck of a "fish" located in an oil or gas well in order to retrieve a drill string, tools or other objects from the well bore. The need to retrieve such objects is frequently realized in the drilling of oil and gas wells due to operating and mechanical failure and the need for a reliable, fluid-activated connecting and disengaging fishing tool for achieving this purpose is well recognized.

2. Description of Related Art

Incorporated here in its entirety by reference is the description of prior art in U.S. application Ser. No. 08/675,087 filed on Jul. 3, 1996 now U.S. Pat. No. 5,791,712.

SUMMARY OF THE PRESENT INVENTION

The present invention, in certain embodiments, provides a wellbore fishing tool (e.g. a spear or overshot) which has a housing; fluid actuated piston apparatus disposed for reciprocation in the housing; and finger apparatus for selectively engaging and gripping the object, whereby the finger apparatus is pivotally displaced with respect to said piston apparatus responsive to reciprocation of the piston apparatus in the housing, for selective engagement and release of the object by the finger apparatus. In one aspect a bias device is provided in the housing for engaging the piston apparatus for normally biasing the piston apparatus into a first selected position in the housing.

In one aspect such a wellbore fishing tool is an overshot with a plurality of finger devices hingedly connected to an inner body and movable inwardly in response to an outer sleeve pushed down by a spring. Initially the spring is held in compression (and the sleeve is therefore maintained in an "up" position) by the force of fluid under pressure pumped into a chamber defined by an exterior surface of the inner body and an interior surface of the sleeve. Release of the pressure allows the spring to act on the sleeve to move it down to contact the finger devices which pivot on their hinges and move inwardly.

In another aspect a spear fishing tool is provided which is capable of being lowered into a well bore and securely engaging a "fish" in a wellbore, which tool includes a cylindrical housing fitted with a normally upwardly-biased, spring-loaded piston and multiple latch fingers having an operating end or lobe selectively radially movable into and from a groove provided in the working end of the piston. Engagement of the working end of the spear fishing tool with the down-hole fish is effected by initial application of hydraulic working fluid pressure on the piston to displace the piston downwardly against the bias of the spring and facilitate radial recession of the latch finger lobes into the groove in the piston. This action allows the working end of the tool to be fully inserted into the fish. Securing of the tool to the fish is then effected by release of hydraulic working fluid pressure from the piston, which allows the spring tension to return the piston to its original position, wherein the piston groove and the latch finger lobes are mismatched, which action forces the latch finger lobes radially outwardly into engagement with the slot provided in the fish. Disengagement of the spear fishing tool from the fish is accomplished by reversing these steps.

It is, therefore, an object of this invention to provide new, unique, useful, efficient, effective and nonobvious wellbore fishing tools, including spears and overshots.

It is an object of this invention to provide a new and improved, simplified spear fishing tool for removing "fish" of various character from a wellbore which tool includes a housing equipped at one end for receiving multiple, radially spaced-apart latch fingers and a fluid-actuated piston slidably extending through the housing and fitted with a piston groove, slot or slots for selectively receiving the engaging ends of the latch fingers and allowing the housing to extend into the fish wherein the latch fingers then engage the fish responsive to reciprocation of the piston to mismatch the piston groove and the engaging ends of the latch fingers and remove the fish from the well.

Another object of this invention is to provide a new and improved spear fishing tool which may be typically suspended from the end of a length of tubing and includes a housing fitted with a fluid-operated piston and multiple latch fingers laterally or radially movably mounted in the housing and a slot or groove provided in the piston, such that the piston may be reciprocated within the housing to initially facilitate alignment and recessing of the engaging ends or lobes of the latch fingers with the slot or groove, insertion of the working end of the tool into the fish and the piston subsequently again reciprocated inside the tool housing in the opposite direction to disengage the latch finger lobes from the slot or groove in the piston and cause the lobes to engage the fish.

A still further object of this invention is to provide a new and improved spear fishing tool for removing various objects, or fish from a wellbore, which tool includes a cylindrical housing of sufficient size to fit in the well bore and fitted with a reciprocating piston having one or more slots or a groove at the working end and a return spring provided in the housing and operable to normally bias the piston in an upward position in the housing. Multiple latch fingers are also movably radially positioned on the housing by means of a slotted collar threaded on the housing for selective pivotal engagement with the slot(s) or groove of the piston. The tool may be lowered into the well bore and the working end of the tool inserted in the opening or neck of a fish responsive to extension of the piston with respect to the housing against the bias of the return spring by application of fluid pressure. This action causes the piston slot(s) or groove to align with the operating ends or lobes of the latch fingers and the lobes to move or pivot inwardly and engage the groove or slot(s) in the piston. Release of fluid pressure from the piston when the working end of the tool is fully inserted in the fish causes the piston to move upwardly, mismatching the piston groove or slots, and the finger lobes and thus disengaging the latch finger lobes from the groove or slot(s) in the piston and engaging the lobes with the slot or groove provided in the fish.

The present invention, in certain embodiments, discloses, an apparatus for retrieving an object from a wellbore, the apparatus having an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus (e.g., but not limited to a spring or springs) contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers movably connected to the inner body, each of the plurality of fingers initially disposed in one of the plurality of finger slots of the inner body, and the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member; such an apparatus of with a hollow upper sub connectible to a tubular string in a wellbore and having a lower end and wherein the bias apparatus is a spring biased against the lower end of the hollow upper sub and an inner shoulder of the fluid actuable member; and such apparatus wherein the plurality of fingers are hingedly connected to the inner body; any such apparatus wherein each finger of the plurality of fingers has a downwardly projecting finger end disposed between an outer surface of the inner body and an inner surface of the fluid actuable member and the apparatus has finger springs, one each of the finger springs disposed between the inner body and a finger end of each finger to urge each finger of the plurality of fingers outwardly and away from the longitudinal flow bore of the inner body; any such apparatus wherein the fluid actuable member is a hollow sleeve sealingly surrounding the inner body and movable thereon.

In one aspect the present invention teaches an apparatus for retrieving an object from a wellbore which has an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers hingedly connected to the inner body, each of the plurality of fingers initially disposed in one of the plurality of finger slots of the inner body, the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, a hollow upper sub connected to the inner body and connectible to a tubular string in a wellbore and having a lower end and wherein the bias apparatus is a spring biased against the lower end of the hollow upper sub and an inner shoulder of the fluid actuable member, each finger of the plurality of fingers having a downwardly projecting finger end disposed between an outer surface of the inner body and an inner surface of the fluid actuable member, finger springs, one each of the finger springs disposed between the inner body and a finger end of each finger to urge each finger of the plurality of fingers outwardly and away from the longitudinal flow bore of the inner body, and the fluid actuable member comprising a hollow sleeve sealingly surrounding the inner body and movable thereon.

The present invention discloses, in certain embodiments an apparatus for retrieving an object from a wellbore, the apparatus having a body, a fluid responsive member disposed for reciprocation with respect to said body, bias means for biasing said fluid responsive member in a selected position with respect to said body, a bore longitudinally extending through said body for flushing the object with the fluid, a plurality of finger slots radially disposed in said body, and a plurality of fingers movably disposed in said body for selectively engaging and gripping the object, said fluid responsive member movable in response to fluid in said bore of said body and in response to force of said bias means for reciprocation with respect to said inner body to contact said plurality of fingers for selective engagement and release of the object by said plurality of fingers.

The present invention discloses a method of gripping and selectively releasing an object in a wellbore including lowering into the wellbore a retrieving apparatus having a body, at least one finger in said body, said finger having a finger lobe on one end for engaging the object and a fluid responsive member movable with respect to said body and having at least one finger slot for selectively receiving said one end of said finger, and moving said fluid responsive member with respect to said body to move said at least one finger from said finger slot to engage the object.

The present invention discloses a method for retrieving an object from a wellbore, the method including sending operating fluid under pressure into an action chamber of a retrieval apparatus, the retrieval apparatus having an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers movably connected to the inner body, each of the plurality of fingers initially disposed in one of the plurality of finger slots of the inner body, and the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, the pressure of the operating fluid holding the fluid actuable member against the bias apparatus; lowering the retrieval apparatus into the wellbore to contact the object to be retrieved; stopping flow of the operating fluid to the retrieval apparatus so that the bias apparatus moves the fluid actuable member to contact and move the plurality of fingers from their finger slots to engage the object to be retrieved; and removing the retrieval apparatus and object to be retrieved from the wellbore; such a method including flushing the object to be retrieved with operating fluid flowing from the retrieval apparatus; such a method wherein the retreival apparatus further comprises a hollow upper sub connectible to a tubular string in a wellbore and having a lower end and wherein the bias apparatus is a spring biased against the lower end of the hollow upper sub and an inner shoulder of the fluid actuable member, and the method further includes releasably biasing the bias apparatus against the lower end of the hollow upper sub and the inner shoulder of the fluid actuable member; such a method wherein each finger of the plurality of fingers has a downwardly projecting finger end disposed between an outer surface of the inner body and an inner surface of the fluid actuable member and the apparatus further comprising finger springs, one each of the finger springs disposed between the inner body and a finger end of each finger to urge each finger of the plurality of fingers outwardly and away from the longitudinal flow bore of the inner body, and the method further includes contacting the downwardly projecting finger ends with the fluid actuable member to move the plurality of fingers.

The present invention discloses, in certain embodiments, a method for retrieving an object from a wellbore, the method including sending operating fluid under pressure into an action chamber of a retrieval apparatus, the retrieval apparatus comprising an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers movably connected to the inner body, each of the plurality of fingers initially disposed in one of the plurality of finger slots of the inner body, and the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, the pressure of the operating fluid holding the fluid actuable member against the bias apparatus; lowering the retrieval apparatus into the wellbore to contact the object to be retrieved; stopping flow of the operating fluid to the retrieval apparatus so that the bias apparatus moves the fluid actuable member to contact and move the plurality of fingers from their finger slots to engage the object to be retrieved; removing the retrieval apparatus and object to be retrieved from the wellbore; flushing the object to be retrieved with operating fluid flowing from the retrieval apparatus; the retreival apparatus having a hollow upper sub connectible to a tubular string in a wellbore and having a lower end and wherein the bias apparatus is a spring biased against the lower end of the hollow upper sub and an inner shoulder of the fluid actuable member; releasably biasing the bias apparatus against the lower end of the hollow upper sub and the inner shoulder of the fluid actuable member; each finger of the plurality of fingers having a downwardly projecting finger end disposed between an outer surface of the inner body and an inner surface of the fluid actuable member and the apparatus further comprising finger springs, one each of the finger springs disposed between the inner body and a finger end of each finger to urge each finger of the plurality of fingers outwardly and away from the longitudinal flow bore of the inner body; and contacting the downwardly projecting finger ends with the fluid actuable member to move the plurality of fingers.

Embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, creations, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
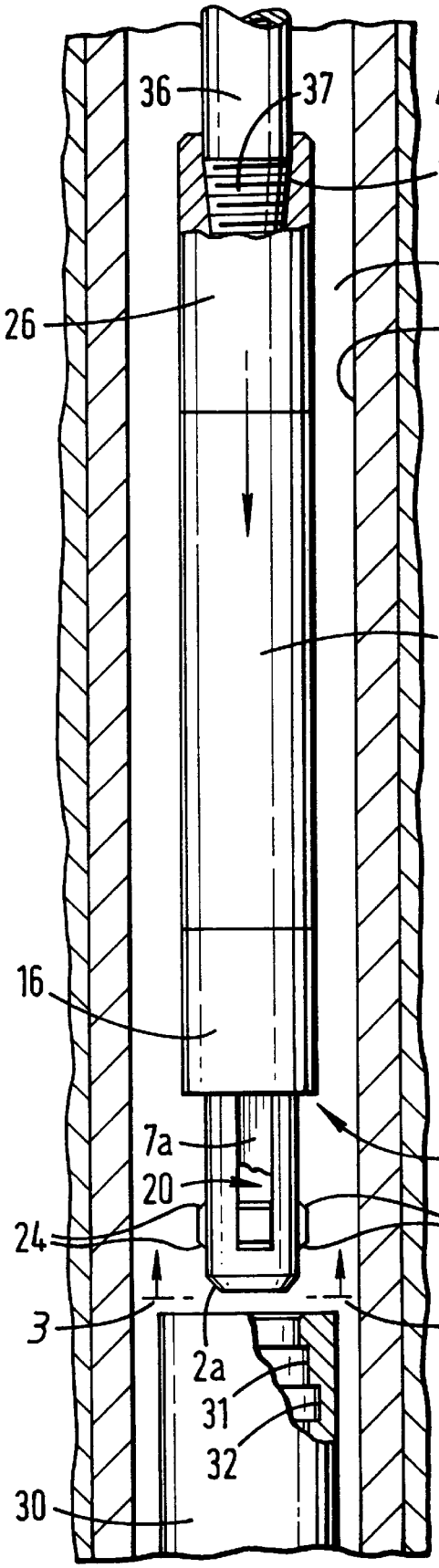
FIG. 1 is a perspective view, partially in section, of a preferred embodiment of a spear fishing tool of this invention.
Figure 2:
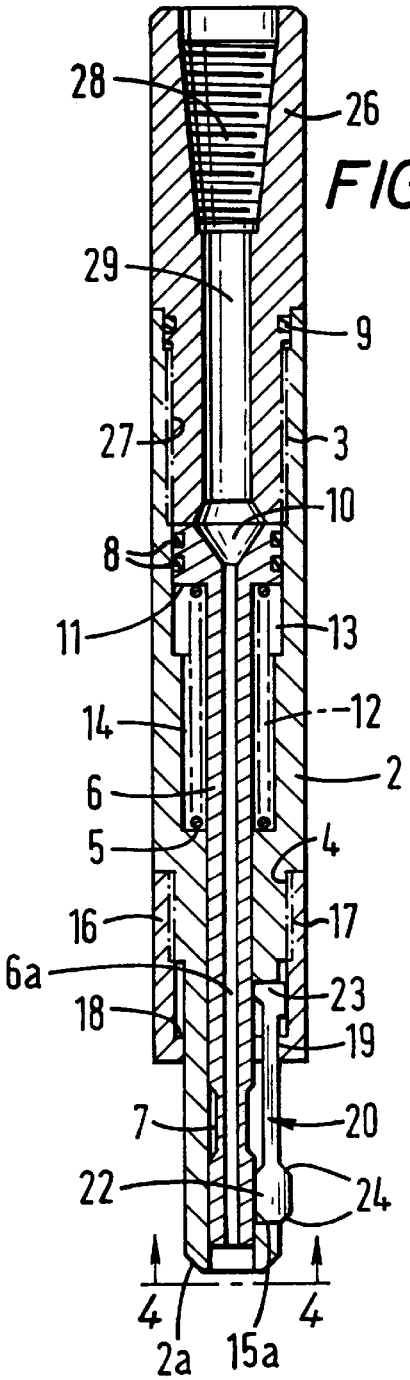
FIG. 2 is a longitudinal sectional view of the spear fishing tool illustrated in FIG. 1.
Figure 3:
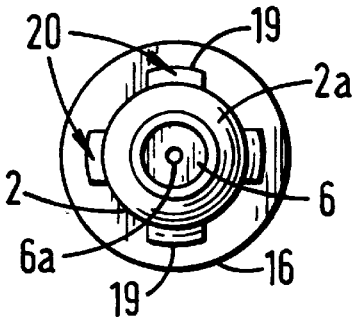
FIG. 3 is an end view taken along line 3—3 of the working or operating end of the spear fishing tool illustrated in FIG. 1, with four latch fingers mounted in the housing.

Referring initially to FIGS. 1–5 of the drawings, in a preferred embodiment a spear fishing tool of this invention is generally illustrated by reference numeral 1. The spear fishing tool 1 is characterized by a cylindrical housing 2, provided with a housing bevel 2*a* at the working end thereof and fitted with housing-sub threads 3 at the opposite or mounting end thereof. The housing 2 is attached to a top sub 26 at the mounting end by means of sub-housing threads 27 and the top sub 26 is fitted with a sub bore 29 and conventional internal sub threads 28 for threadable attachment to a length of tubing 36, having cooperating tubing 26 threads 37, for suspending the spear fishing tool 1 into a well bore 34, typically fitted with casing 35. The housing 2 is further provided with housing collar threads 4 and an internal housing shoulder 5 for receiving one end of a piston spring 12, the opposite end of which piston spring 12 extends upwardly through a spring chamber 14 into a wider piston travel space 13 as illustrated in FIG. 2. A piston 6 is slidably disposed within the housing 2 and is characterized by a longitudinal piston bore 6*a*, a piston slot or groove 7 provided in the working end of the piston 6 and piston seals 8 provided in the larger upper end of the piston 6, which seal the reciprocating travel of the large end of the piston 6 through the piston travel space 13, against the bias of the piston spring 12 as hereinafter further described. The upper end of the piston spring 12 engages the piston shoulder 11 of the piston 6, as illustrated in FIG. 2. A housing seal 9 is provided between the housing and the top sub 26, as illustrated in FIG. 2. In a preferred embodiment of the invention a piston bevel 10 is provided in the upper end of the piston 6 to accommodate hydraulic fluid 33, illustrated in FIGS. 6B and 6C, which is pumped down the tubing 36 and through the sub bore 29, against the piston bevel 10 of the piston 6, for displacing the piston 6 through the piston travel space 13 against the bias of the piston spring 12. Hydraulic fluid 33 is also allowed to flow through the piston bore 6*a*, as further hereinafter described during the operational phase of the spear fishing tool 1, for the purpose of clearing the fish groove 31 and fish opening 32 of sand and other foreign material.

Figure 4:
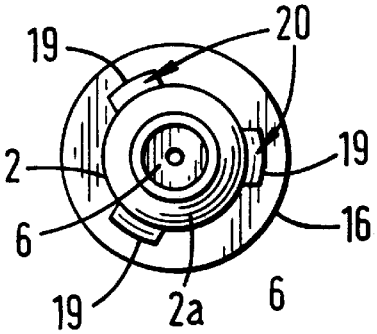
FIG. 4 is an end view of the working or operating end of the fishing tool illustrated in FIG. 1 with three latch fingers mounted in the housing.
Figure 5:
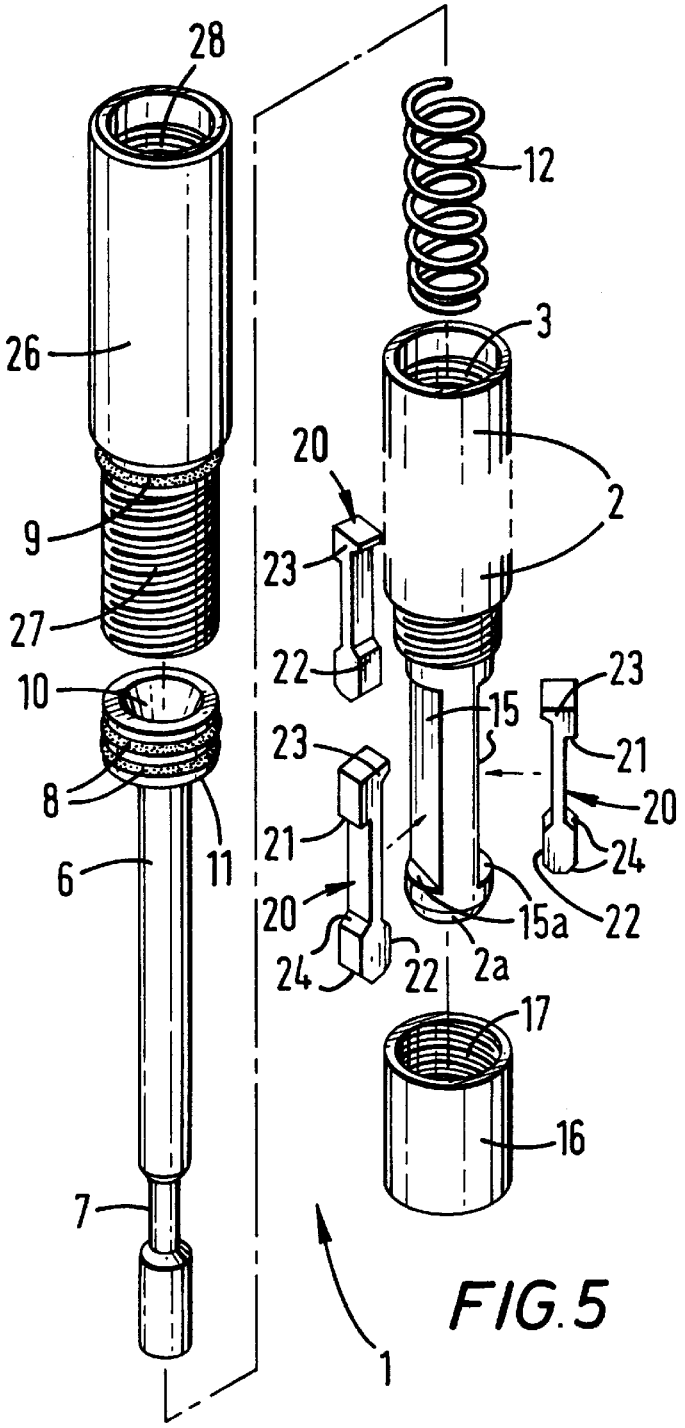
FIG. 5 is an exploded view of the spear fishing tool.

Referring now to FIGS. 2, 4 and 5 of the drawings, in a most preferred embodiment of the invention the working end of the housing 2 is fitted with a housing bevel 2*a* and a seat bevel 15*a* is provided in each of multiple finger seats 15, radially disposed around the periphery of the working end of the housing 2. Furthermore, latch fingers 20 are seated in the respective finger seats 15 spaced in the housing 2 and each of the latch fingers 20 is provided with a finger shoulder 21, which lies adjacent to a corresponding collar shoulder 18 of a finger collar 16, which is threaded on the working end of the housing 2 by means of collar threads 17. The finger base 23 of each of the latch fingers 20 lies adjacent to the upper end of the respective finger seat 15. The finger collar 16 is further provided with collar opening 19 at the bottom thereof, to accommodate the respective latch fingers 20, as illustrated in FIG. 2. Accordingly, when the finger collar 16 is threaded on the collar threads 4 of the housing 2 and the latch fingers 20 are extended through the collar opening 19 and positioned in the corresponding finger seats 15 provided in the housing 2, the latch fingers 20 are prevented from exiting the finger seats 15 but are not tightly secured therein. The latch fingers 20 are each further provided with a finger lobe 22 which extends inwardly of the latch fingers 20 toward the piston 6 and the finger lobes 22 are normally disposed alongside the circumference of the piston 6 below the piston slot or groove 7, as further illustrated in FIG. 2. The bottom ends of the latch fingers 20 are normally seated on the seat bevel 15*a* of the piston 6 when the piston spring 12 is relaxed and the piston 6 remains in its extreme upward travel position against the base of the top sub 26 and clearing the piston travel space 13, as still further illustrated in FIG. 2. In another preferred embodiment of the invention a finger bevel 24 is provided on the top and bottom ends of each of the latch fingers 20 for engaging a fish 30, located in the wellbore 34, for attachment to and removal from the fish 30, as hereinafter further described with respect to FIGS. 6A–6D. As further illustrated in FIGS. 6A–6D, the fish 30 is characterized by a fish opening 32, in the periphery of which is defined the fish groove 31, which is compatible dimensionally with the projecting outer edge of the latch fingers 20.

Figure 6A:
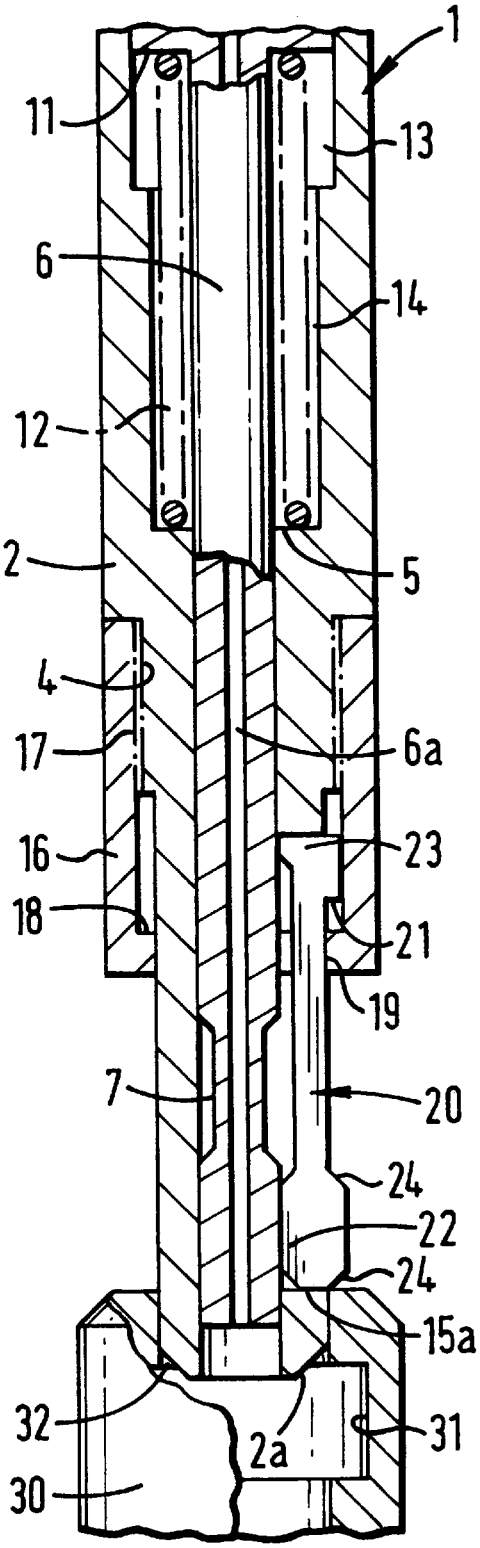
FIG. 6A is a sectional view of the spear fishing tool in operation with the working end engaging a fish.
Figure 6B:
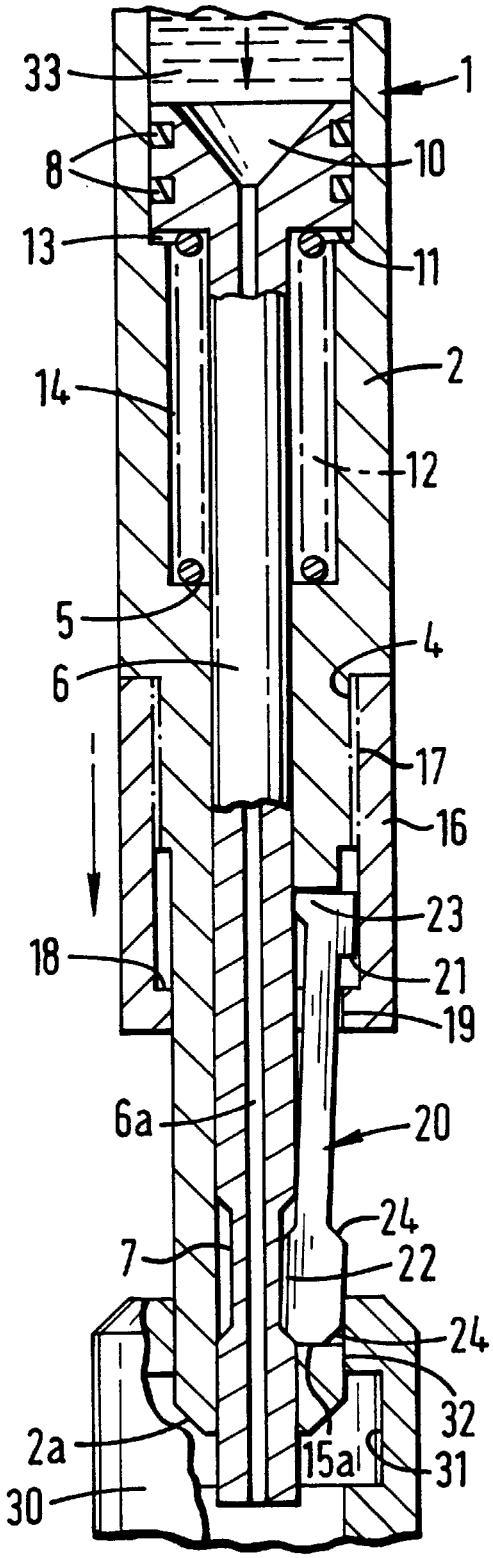
FIG. 6B is a sectional view of the spear fishing tool in operation, with the latch finger lobes retracted and ready for entry into the fish.
Figure 6C:
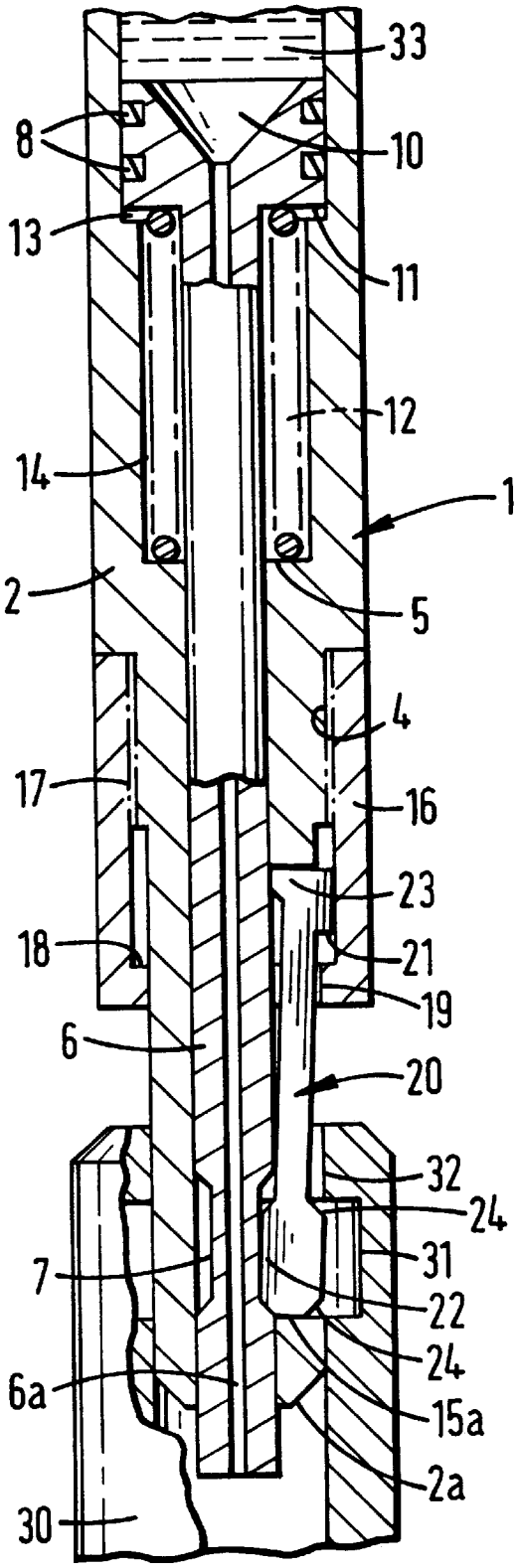
FIG. 6C is a sectional view of the spear fishing tool in operation, with the retracted latch fingers positioned adjacent to a groove or slot in the fish.
Figure 6D:
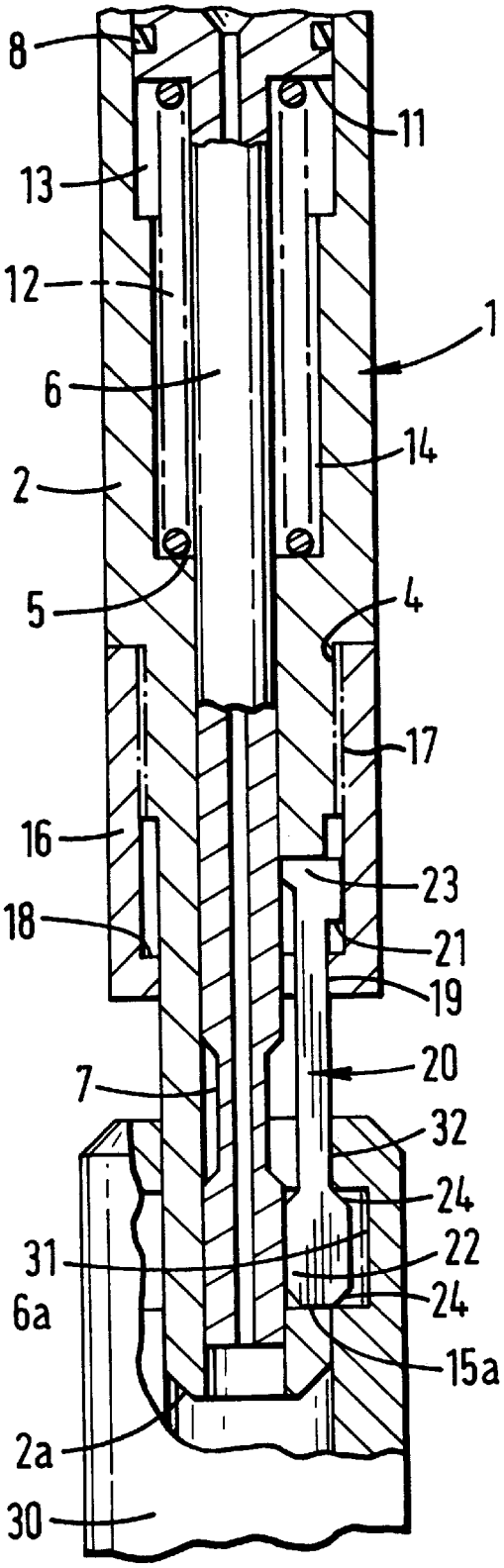
FIG. 6D is a sectional view of the spear fishing tool in operation, with the latch finger lobes radially and pivotally extended into the groove or slot in the fish.

In operation, and referring now to FIGS. 6A–6D, the spear fishing tool 1 is suspended by means of the top sub 26 and the tubing 36 or other suspension apparatus into the well bore 34 until the working end of the spear fishing tool 1 approaches the object to be engaged, such as the fish 30. Referring initially to FIG. 6A, as the working end of the housing 2 enters the fish opening 32 and the bottom finger bevel 24 of each of the respective latch fingers 20 contact the fish 30 at the fish opening 32, hydraulic or working fluid 33 pressure is exerted by means of a suitable pump (not illustrated) through the tubing 36 and the sub bore 29 on the piston bevel 10 of the piston 6, against the bias of the piston spring 12. This action causes the piston 6 to displace downwardly with respect to the housing 3 and close the piston travel space 13 as the piston spring 12 compresses as illustrated by the piston arrow in FIG. 6B. Working fluid 33 also traverses the piston bore 6*a* and washes sand and foreign matter from the underlying fish 30. Continued downward movement of the piston 6 responsive to the pressure of the hydraulic fluid 33 in the sub bore 29 causes the piston slot or groove 7 to align with the respective finger lobes 22 of the corresponding latch fingers 20 and the pressure of the fish 30 against the respective bottom finger bevels 24 of the latch fingers 20 pivots the latch fingers 20 at each finger base 23 and forces the finger lobes 22 radially into the piston slot or groove 7, thus facilitating movement of the working end of the spear fishing tool 1 farther into the fish opening 32, as further illustrated in FIG. 6B. Each of the latch fingers 20 remain depressed with the corresponding finger lobes 22 seated in the matching piston slot or groove 7 as the working end of the spear fishing tool 1 moves through the fish opening 32 and the respective latch fingers 20 align with the conventional fish groove 31 provided in the fish 30, as illustrated in FIG. 6C. When alignment of the latch fingers 20 with the fish groove 31 is effected, hydraulic or working fluid 33 pressure is released from the tubing 36 of the sub bore 29 and the piston spring 12 extends thus facilitating upward movement of the piston 6 with respect to the housing 3 as indicated by the piston arrow in FIG. 6D. This action misaligns the piston slot or groove 7 with the corresponding finger lobes 22 in the corresponding latch fingers 20 and forces the finger lobes 22 radially from the piston slot or groove 7 and pivotally from the finger base 23, such that the latch fingers 20 now engage and are seated in the fish groove 31 of the fish 30. The spear fishing tool 1 is now securely yet removably, engaged with the fish 30 and the fish 30 may be removed by upward pressure exerted on the spear fishing tool 1 according to conventional techniques.

Under circumstances where it is desired to disengage the spear fishing tool 1 from the fish 30 after either relocating the fish 30 or for other purposes, hydraulic or working fluid 33 pressure is again applied to the tubing 36 and the sub bore 29 and is exerted against the piston bevel 10 of the piston 6 to again force the piston 6 downwardly against the tension in the piston spring 12 and align the piston slot or grooves 7 with the respective finger lobes 22 of the corresponding latch fingers 20. The spear fishing tool 1 is then lifted and as pressure is exerted against the top finger bevel 24 by the fish 30, each of the finger lobes 22 are depressed into the aligned piston slot or groove 7 and the spear fishing tool 1 is quickly and easily disengaged from the fish 30, through the fish opening 32, as illustrated in FIGS. 6B and 6C. Hydraulic or working fluid 33 pressure is then released from the sub bore 29 and the piston 6 to effect return of the piston 6 to the position illustrated in FIG. 6A by operation of the piston spring 12 and extension of the respective finger lobes 22 of the latch fingers 20 from the misaligned piston slots or groove 7.

It will be appreciated by those skilled in the art that the fishing tools of this invention are characterized by simplicity, convenience and positive action in both engaging and disengaging fish of substantially any description having a compatible engaging and latching configuration. The spear fishing tool 1 incorporates a single internal piston spring and requires no external springs for operation of the respective latch fingers 20 and the tool may be quickly and easily repaired and the latch fingers 20 removed and replaced or repaired by unthreading the finger collar 16 from the housing 2. Furthermore, referring to FIG. 3 of the drawings, a selected number of latch fingers 20, (four of which are illustrated) can be pivoted in the spear fishing tool 1, depending upon the lifting force required to remove the fish and the desired diameter of the housing 2. Moreover, the fishing tools of this invention can be constructed in substantially any size for operation in cased and uncased wellbores of varying diameter and with engagement of fish of varied description, in substantially any working environment. Moreover, the fishing tools are compatible with fluid pumps, including conventional mud pumps, hydraulic pumps and other hydraulic fluid and working fluid pressure apparatus for downhole operation since working fluid pressure is applied to the conventional tubing in a conventional manner.

Referring again to FIGS. 1 and 2 of the drawings, it will be further appreciated by those skilled in the art that the piston slot 7 can be either a continuous groove, as illustrated in FIG. 5, or multiple slots, depending upon the desired design of the working end of the housing 2. For example, discrete piston slots 7 can be provided in each circumstance where the latch fingers 20 are mounted radially around the diameter of the housing 2 and in the areas where the respective finger lobes 22 align with the piston 6. Alternatively, a single circular piston slot or groove 7 may be provided, as desired. In each case, the finger lobes 22 of the respective latch fingers 20 are able to recess in the piston slot(s) or groove 7 during operation of the spear fishing tool 1, as heretofore described.

Figure 7A:
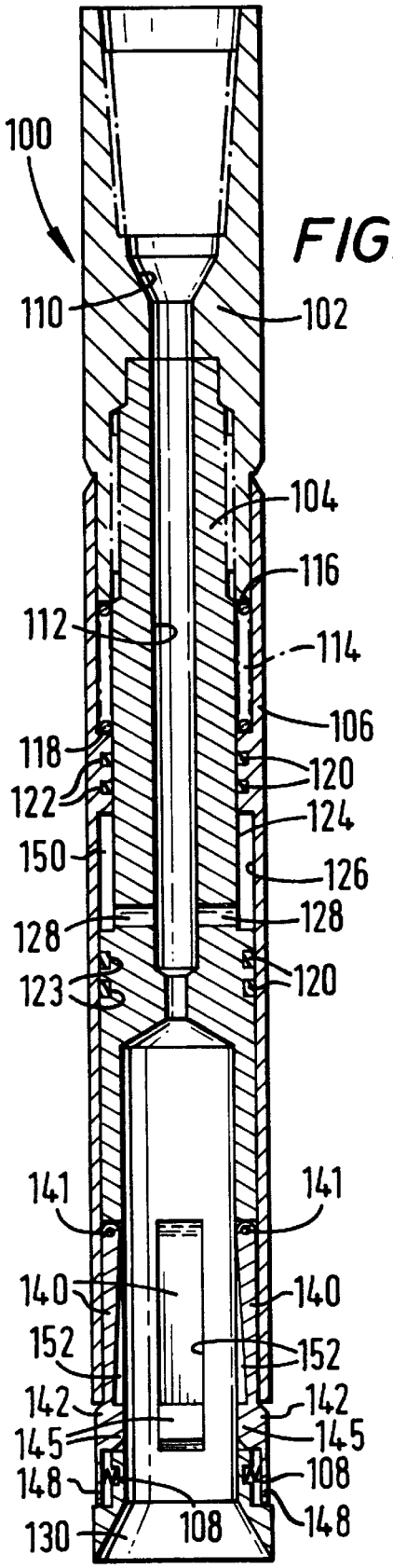
FIGS. 7A and 7B are cross-sectional views of an overshot fishing tool according to the present invention.
Figure 7B:
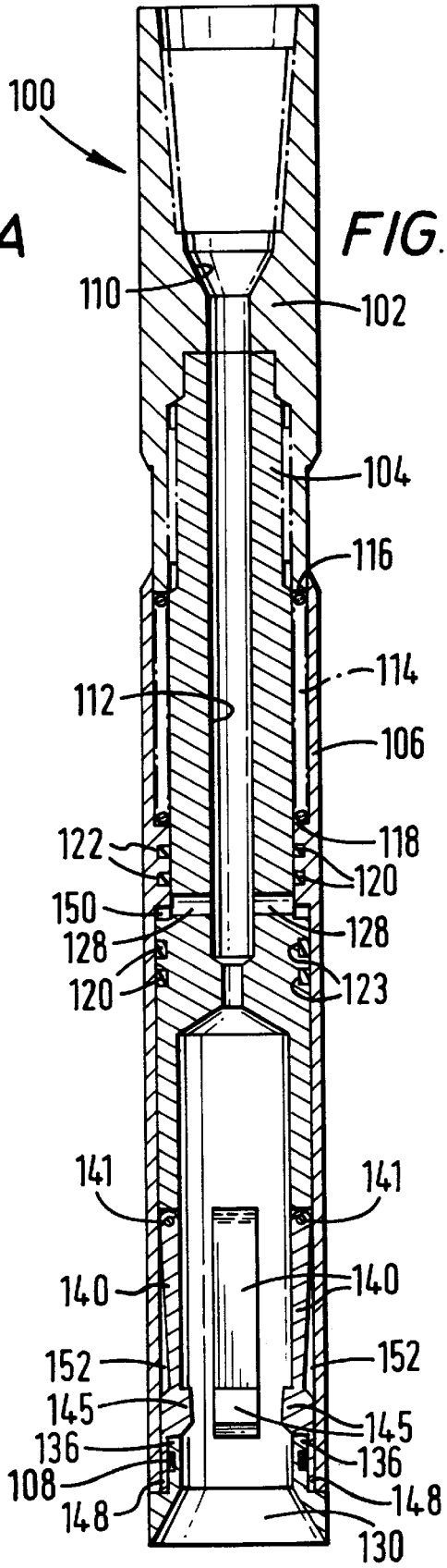

FIGS. 7A and 7B show a wellbore overshot fishing tool 100 according to the present invention which has an upper sub 102 threadedly connected to an inner body 104. A sleeve 106 is movably disposed around the upper sub 102 and inner body 104. A plurality of four finger devices 140 (three shown in FIG. 7A) in finger slots 152 of the inner body 104 are hingedly connected to a lower end of the inner body 104 and initially biased outwardly by springs 108.

The upper sub 102 has a fluid flow bore 110 which is in fluid communication with a fluid flow bore 112 of the inner body 104.

A spring 114 is biased at the top against a lower end 116 of the upper sub 102 and at the bottom against a shoulder 118 of the sleeve 106. Seals (e.g. o-rings) 120 in recesses 122 of the sleeve 106 and 123 of the inner body 104 seal the sleeve/inner body interfaces.

An outer surface 124 of the inner body 104 and an inner surface 126 of the sleeve 106 define an action chamber 150 which is in fluid communication with the inner body's fluid flow bore 112 via flow channels 128. The introduction of fluid (e.g. pumped from the surface down through a tubular string to which the tool 100 is connected) at sufficient pressure maintains the spring 114 in the compressed "run in" position of FIG. 7A. The pumped fluid (e.g. water, drilling fluid, etc.) flows out through a lower end 130 of the inner body 104.

Reduction of the pressure of the pumped fluid allows the spring 114 to push the sleeve 106 down to contact finger projections 142 of the finger devices 140, overcoming the force of the springs 108 which are interconnected between ribs 136 of the inner body 104 and finger ends 148 of the finger devices 140, and thereby pivoting the finger devices 140 on their hinges 141 which hingedly mount them to the inner body 104. The thus pivoted finger devices have inner projections 145 which are movable inwardly to grasp a fish and, in one aspect, to enter into a groove recess, or recesses on the fish to facilitate gripping thereof and removal. The lowered sleeve 106 maintains the finger devices 140 in the "set" position of FIG. 7B until fluid at sufficient pressure is again pumped into the action chamber 150, pushing the sleeve 106 up against the force of the spring 114 and releasing the finger devices 140 from the "set" position for return to the "run in" position of FIG. 7A.

While certain preferred embodiments of the invention have been described above, it will be recognized and understood that various modifications may be made in the invention and the appended claims are intended to cover all such modifications which may fall within the scope and spirit of the invention.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. An apparatus for retrieving an object from a wellbore, the apparatus comprising an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers hingedly connected to the inner body, each of the plurality of fingers initially disposed in one of the plurality of finger slots of the inner body, the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, a hollow upper sub connected to the inner body and connectible to a tubular string in a wellbore and having a lower end and wherein the bias apparatus is a spring biased against the lower end of the hollow upper sub and an inner shoulder of the fluid actuable member, each finger of the plurality of fingers having a downwardly projecting finger end disposed between an outer surface of the inner body and an inner surface of the fluid actuable member, finger springs, one each of the finger springs disposed between the inner body and a finger end of each finger to urge each finger of the plurality of fingers outwardly and away from the longitudinal flow bore of the inner body, and the fluid actuable member comprising a hollow sleeve sealingly surrounding the inner body and movable thereon.

2. An apparatus for retrieving an object from a wellbore, the apparatus comprising an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers movably connected to the inner body, each of the plurality of fingers initially disposed in one of the plurality of finger slots of the inner body, the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, and a hollow upper sub connectible to a tubular string in a wellbore and having a lower end and wherein the bias apparatus is a spring biased against the lower end of the hollow upper sub and an inner shoulder of the fluid actuable member.

3. The apparatus of claim 2 wherein the fluid actuable member is a hollow sleeve sealingly surrounding the inner body and movable thereon.

4. An apparatus for retrieving an object from a wellbore, the apparatus comprising an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers movably connected to the inner body, each of the plurality of fingers initially disposed in one of the plurality of finger slots of the inner body, the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, and wherein the plurality of fingers are hingedly connected to the inner body.

5. The apparatus of claim 4 wherein the fluid actuable member is a hollow sleeve sealingly surrounding the inner body and movable thereon.

6. apparatus for retrieving an object from a wellbore, the apparatus comprising an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers movably connected to the inner body, each of the plurality of fingers initially disposed in one of the plurality of finger slots of the inner body, the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, wherein each finger of the plurality of fingers has a downwardly projecting finger end disposed between an outer surface of the inner body and an inner surface of the fluid actuable member, and finger springs, one each of the finger springs disposed between the inner body and a finger end of each finger to urge each finger of the plurality of fingers outwardly and away from the longitudinal flow bore of the inner body.

7. The apparatus of claim 6 wherein the fluid actuable member is a hollow sleeve sealingly surrounding the inner body and movable thereon.

8. A method for retrieving an object from a wellbore, the method comprising sending operating fluid under pressure into an action chamber of a retrieval apparatus, the retrieval apparatus comprising an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers movably connected to the inner body, each of the plurality of fingers initially disposed in one of the plurality of finger slots of the inner body, and the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, the pressure of the operating fluid holding the fluid actuable member against the bias apparatus, lowering the retrieval apparatus into the wellbore to contact the object to be retrieved, stopping flow of the operating fluid to the retrieval apparatus so that the bias apparatus moves the fluid actuable member to contact and move the plurality of fingers from their finger slots to engage the object to be retrieved, removing the retrieval apparatus and object to be retrieved from the wellbore, wherein the retrieval apparatus further comprises a hollow upper sub connectible to a tubular string in a wellbore and having a lower end and wherein the bias apparatus is a spring biased against the lower end of the hollow upper sub and an inner shoulder of the fluid actuable member, and the method further comprising releasably biasing the bias apparatus against the lower end of the hollow upper sub and the inner shoulder of the fluid actuable member.

9. The method of claim 8 further comprising flushing the object to be retrieved with operating fluid flowing from the retrieval apparatus.

10. A method for retrieving an object from a wellbore, the method comprising sending operating fluid under pressure into an action chamber of a retrieval apparatus, the retrieval apparatus comprising an inner body having a top end, a bottom end, and a longitudinal fluid flow bore therethrough from the top end to the bottom end, and at least one lateral flow bore therethrough in fluid communication with the longitudinal fluid flow bore, the bottom end having an opening suitable for receiving therein a portion of an object in a wellbore, a fluid actuable member disposed for reciprocation with respect to the inner body, bias apparatus contacting the fluid actuable member for moving the fluid actuable member with respect to the inner body, an action chamber between the inner body and the fluid actuable member, the action chamber in fluid communication with the lateral flow bore of the inner body, a plurality of finger slots in the bottom end of the inner body, a plurality of fingers movably connected to the inner body, each of the plurality of fingers initially disposed in one of the plurality of finger slots of the inner body, and the fluid actuable member disposed so that the bias apparatus can push the fluid actuable member down to contact the plurality of fingers and move them into the longitudinal flow bore of the inner body to engage the object in the wellbore when insufficient fluid pressure is present in the action chamber to overcome force of the bias apparatus in the fluid actuable member, the pressure of the operating fluid holding the fluid actuable member against the bias apparatus, lowering the retrieval apparatus into the wellbore to contact the object to be retrieved, stopping flow of the operating fluid to the retrieval apparatus so that the bias apparatus moves the fluid actuable member to contact and move the plurality of fingers from their finger slots to engage the object to be retrieved, removing the retrieval apparatus and object to be retrieved from the wellbore, wherein each finger of the plurality of fingers has a downwardly projecting finger end disposed between an outer surface of the inner body and an inner surface of the fluid actuable member and the apparatus further comprising finger springs, one each of the finger springs disposed between the inner body and a finger end of each finger to urge each finger of the plurality of fingers outwardly and away from the longitudinal flow bore of the inner body, and the method further comprising contacting the downwardly projecting finger ends with the fluid actuable member to move the plurality of fingers.

11. The method of claim 10 further comprising flushing the object to be retrieved with operating fluid flowing from the retrieval apparatus.

* * * * *